US005438856A

United States Patent [19]

Richter et al.

[11] Patent Number: 5,438,856

[45] Date of Patent: Aug. 8, 1995

[54] CYLINDER ASSEMBLY FOR PLATE TUMBLER LOCK

[75] Inventors: Carl E. Richter, Milwaukee; Ronald R. Krebs, Fond du Lac, both of Wis.

[73] Assignee: Strattec Security Corporation, Milwaukee, Wis.

[21] Appl. No.: 253,756

[22] Filed: Jun. 3, 1994

[51] Int. Cl.[6] ..... E05B 29/04

[52] U.S. Cl. ..... 70/492; 70/377

[58] Field of Search ..... 70/492, 495, 375, 377, 70/392, 376, 382, 367–369, DIG. 15

[56] References Cited

U.S. PATENT DOCUMENTS

| | | | |
|---|---|---|---|
| 1,218,065 | 3/1917 | Diesel | 70/492 |
| 2,623,959 | 12/1952 | Jarrett | 70/495 X |
| 2,699,665 | 1/1955 | Pelle | 70/377 |
| 3,137,156 | 6/1964 | Navarro | 70/492 |
| 4,057,987 | 11/1977 | Patriquin | 70/337 X |
| 4,398,405 | 8/1983 | Patriquin | 70/369 |
| 4,416,129 | 11/1983 | Thimot | 70/369 |
| 4,715,201 | 12/1987 | Craig | 70/369 |
| 4,972,695 | 11/1990 | Mochida et al. | 70/492 |
| 5,068,305 | 2/1992 | Myers | 70/369 |

FOREIGN PATENT DOCUMENTS

| | | | |
|---|---|---|---|
| 1074733 | 10/1954 | France | 70/492 |
| 2276447 | 1/1976 | France | 70/377 |
| 0047380 | 2/1991 | Japan | 70/492 |

*Primary Examiner*—Lloyd A. Gall

*Attorney, Agent, or Firm*—Andrus, Sceales, Starke & Sawall

[57] ABSTRACT

A cylinder assembly for a plate tumbler lock includes a removable, self-retained plate tumbler which snap-fits into an assembled position by pivoting the tumbler and pushing the tumbler into its ward until a projecting detent passes by a retaining ledge in the side wall of the ward. The force of the tumbler spring then pivots the tumbler into its assembled position where the detent is engaged with the retaining ledge. The pivoting of the tumbler is accomplished by locating the leg which forms the tumbler spring seat on the tumbler in a position where it does not interfere with the terminal edge which defines the open top of the ward during assembly.

9 Claims, 1 Drawing Sheet

FIG. 1
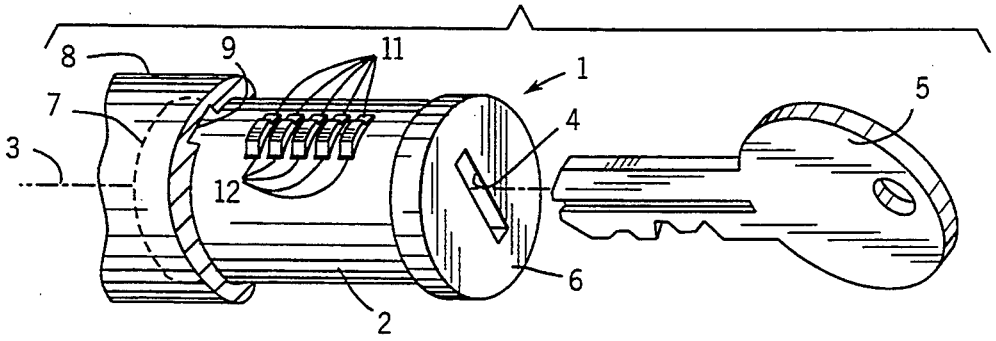
FIG. 2
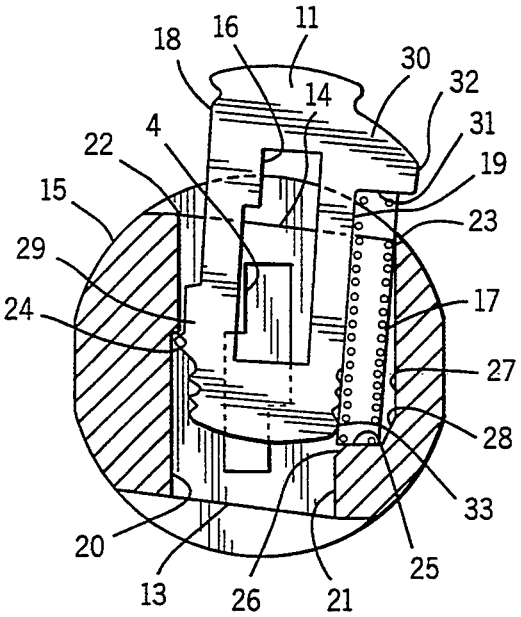
FIG. 3
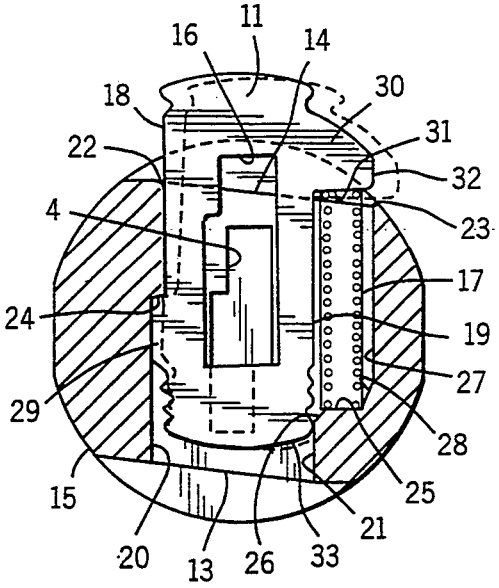
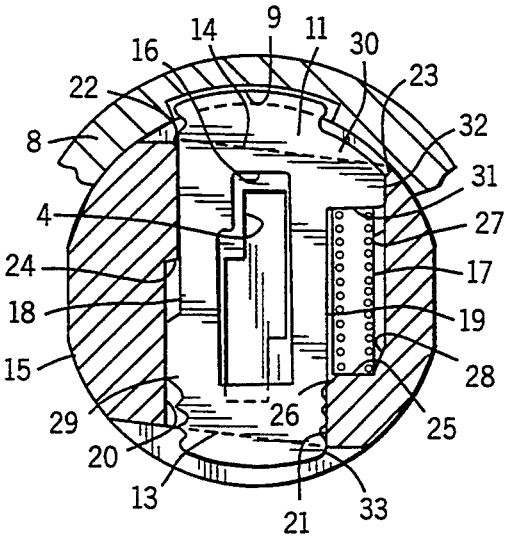
FIG. 4

CYLINDER ASSEMBLY FOR PLATE TUMBLER LOCK

BACKGROUND OF THE INVENTION

The present invention relates to locks, and more particularly to an improved cylinder assembly for a plate tumbler lock which includes a removable, self-retained, snap-in plate tumbler construction.

Conventional plate tumbler locks include a key operated cylinder rotatably mounted in a cylindrical sleeve. The cylinder includes a plurality of plate tumblers which are biased by springs to normally project into the sleeve to prevent rotation of the cylinder. When a properly bitted key is inserted into the key way of the cylinder, and thus through slots formed in each tumbler, the tumblers are retracted from the sleeve into their respective wards to unlock the cylinder and allow the cylinder to rotate within the sleeve.

In the manufacture, shipping and assembling of plate tumbler locks, the tumblers must be retained within the cylinder in order to prevent them from accidently falling out of the cylinder. The plate tumblers are spring loaded and, since each tumbler ward has an open top which opens to the external surface of the cylinder, there is nothing to prevent the springs from urging the plate tumblers from their wards when the cylinder is not contained within a lock housing such as a hollow cylinder sleeve. These cylinders typically are shipped separately from the remaining lock components, such as the sleeve, with the plate tumblers in place and thus the plate tumblers need to be held within the cylinder by some means. If, for example, an assembler accidentally permits one of these plate tumblers to pop out of the cylinder, there is a waste of time during assembly. If, however, two or more plate tumblers should accidentally fall out, the combination might be lost if these plate tumblers are not reinserted into the cylinder in the correct order.

In the past, plate tumblers have been held in place by means of a retaining plate placed over the open top of the tumbler access wards in the cylinder. This retaining plate is typically staked into the cylinder. Other methods of retaining the plate tumblers include tumblers that "snap into" the cylinder by forming a shoulder on the plate tumbler for engagement with a corresponding detent or other means on the cylinder housing. Examples of such retaining methods are shown in the following U.S. Pat. Nos.: 1,726,614; 1,860,708; 2,123,940; 2,890,582; 3,137,156; 4,416,129; 4,672,827.

It is also often desirable for security reasons to remove and replace the tumblers in order to change the keys which will operate the lock, such as for new tenants or employees. Unfortunately, most tumblers utilized in a snap-in construction are themselves not removable once assembled. Also, prior snap-in tumblers are force fit into their respective tumbler wards during assembly. This force fitting of the tumbler during assembly typically causes burrs or metal deformation of either the projecting detent on the tumbler or the retaining ledge in the ward or both resulting in the accuracy of the tumbler being compromised since the tumbler may not properly locate itself against the retaining ledge formed in the ward. Thus, a key may not properly cooperate with such a tumbler resulting in a defective lock.

One self-retained, snap-in tumbler is illustrated and described in U.S. Pat. No. 5,088,305. However, the tumbler described therein, although removable, may still result in deformation of the detent projecting from the tumbler or the retaining ledge on the tumbler ward since the detent must be forced to pass over the retaining ledge.

It would thus be desirable to provide a cylinder assembly having a self-retained snap-in plate tumbler which does not require force fitting of the tumbler during assembly, and which further may be easily removed for replacement when desired.

SUMMARY OF THE INVENTION

A cylinder assembly for a plate tumbler lock is disclosed which includes a snap-in plate tumbler which not only is self-retaining during assembly but also is easily removable when desired. The tumbler is retained within the cylinder for the lock by means of a projecting detent formed along one edge thereof which engages a retaining ledge formed along one side wall of a tumbler ward. Sufficient clearance is provided between the tumbler and the terminal edge of its tumbler ward so that as the tumbler is pressed into its ward, it may be pivoted to eliminate any significant forces acting between its projecting detent, the side wall of the tumbler ward and the retaining ledge. Thus, when the tumbler is inserted into its ward, the projecting detent passes freely by the retaining ledge so that no metal deformation occurs. Once passed the ledge, the tumbler pivots into its assembled position due to the force of the tumbler spring and thus snap-fits into the ward and is self-retained therein. The tumbler can be removed by performing the opposite operation, when desired.

The clearance between the tumbler and terminal edge of its ward may be provided by insuring that the distance between the upper spring seat (formed on the projecting leg of the tumbler) and the lower spring seat (formed in the side wall of the ward) is greater than the distance between the lower spring seat and the terminal edge at the open top of the ward. This may be accomplished by moving the upper spring seat higher on the tumbler leg, or by forming a recess in the side wall of the ward so that the height of the terminal edge forming the open top of the ward adjacent the tumbler leg is lower than the height of the terminal edge forming the open top on the other side of the ward.

The present invention thus provides a simple and inexpensive means whereby plate tumblers are prevented from falling out of the cylinder when the cylinder is disassembled from the complete lock. The present cylinder assembly is particularly advantageous when the cylinder is shipped and when the cylinder is being assembled into the cylinder sleeve of the lock since it prevents the accidental removal of the tumblers by preventing the tumblers from falling out of the cylinder during assembly or shipping.

In another aspect, the present cylinder assembly provides a simple and inexpensive means for not only preventing the accidental removal of the tumblers, but also permitting the intentional removal of the tumblers if desired. In particular, the plate tumblers may be inserted into the cylinder and removed from the cylinder without causing any physical damage to the structure of either of the tumbler itself or the tumbler ward.

BRIEF DESCRIPTION OF THE DRAWINGS

The drawings illustrate the best mode presently contemplated of carrying out the invention.

In the drawings:

FIG. 1 is a perspective view of a lock cylinder including the self-retained, snap-in plate tumblers in accordance with the present invention;

FIG. 2 is a cross-sectional view of the cylinder illustrating the insertion of a tumbler with the tumbler in its pivoted, non-assembled position;

FIG. 3 is a cross-sectional view similar to FIG. 2 illustrating the tumbler in its assembled position; and FIG. 4 is a cross-sectional view similar to FIGS. 2 and 3 illustrating the cylinder within a locking sleeve and the tumbler in its operational, locked position.

DETAILED DESCRIPTION OF THE PREFERRED EMBODIMENT

Referring now to the drawings, FIG. 1 illustrates a lock cylinder generally designated by the numeral 1 constructed in accordance with the principals of the present invention. Cylinder 1 is of the type that may be rotatably mounted within a hollow cylindrical housing or sleeve member 8 which in turn is mounted in the steering column of an automobile. Other uses, however, are contemplated for cylinder 1 and therefore the present invention is not limited to the use as a steering column ignition lock for an automobile.

As shown best in FIGS. 1 and 2, cylinder 1 is in the form of a cylindrical, substantially hollow housing 2 which defines a central longitudinal axis 3 about which cylinder 1 is rotated. Housing 2 includes a central key way 4 disposed along axis 3 for receiving a key 5 in the conventional manner to permit rotation of cylinder 1. Key way 4 opens to its front end at front face 6 of housing 2 and is blind or closed at opposite end 7 of housing 2.

A plurality of plate tumblers 11 are slidably mounted within a corresponding number of tumbler slots or wards 12 contained within housing 2 each of which are orientated transversely in a plane passing perpendicularly through axis 3. Each ward 12 has an open bottom 13 and an open top 14 both of which open to the external cylindrical surface 15 of cylinder 1. Only one plate tumbler 11 in a single ward 12 is illustrated in full in FIGS. 2–4 with the remaining tumblers and wards not illustrated for purposes of simplicity. However, as is conventional, each tumbler 11 is slidably mounted within a corresponding ward 12 that opens to the outer surface 15 of housing 2.

As shown best in FIGS. 2–4, each ward or slot 12 is defined by opposite side walls 20 and 21 in housing 2 which guide tumbler 11 in its sliding movement. Side walls 20 and 21 terminate at terminal edges 22 and 23 respectively, which define the open top 14 for receiving tumblers 11 during assembly or removal thereof. A retaining ledge 24 is formed in side wall 20 of ward 12 for engaging and retaining tumbler 11, as will hereinafter be described. As shown, retaining ledge 24 is in the form of a shoulder approaching about 90°, but other forms of retaining means may also be employed. The opposite side wall 21 of ward 12 includes a flat lower tumbler spring seat 25 formed therein. Like ledge 24, seat 25 is in the form of a 90° shoulder or recess formed in housing 2. Like ledge 24, seat 25 may also be constructed in other conventional constructions so long as a seat is formed for the tumbler biasing spring 17, as will hereinafter be described. A chamfered or inclined surface 26 is formed along the inner edge of seat 25. Surface 26 functions to provide a relief for tumbler 11 during its insertion into ward 12 or its removal from ward 12, and is preferably formed at an angle of about 45°.

As shown best in FIGS. 2–4, each plate tumbler 11 is substantially rectangular in shape having a central key receiving opening 16 and a pair of opposite side edges 18 and 19. Side edge 18 slidably engages wall 20 of ward 12 while opposite side edge 19 slidably engages side wall 21 of ward 12 for guiding tumbler 11 in its sliding movement within ward 12. Each tumbler 11 includes a detent 29 projecting from side edge 18 and a leg 30 projecting from opposite side edge 19. Leg 30 includes a lower fiat surface 31 forming an upper tumbler spring seat which is located opposite from lower seat 25 of housing 2 when tumbler 11 is in its operational position. A tumbler spring 17 extends between and bears against seat 31 at its upper end and seat 25 at its lower end. Tumbler spring 17 thus biases tumbler 11 toward the open top 14 of ward 12 so that tumblers 11 are always biased into their locking position with sleeve 8 and the insertion of key 5 retracts tumblers 11 into wards 12 to unlock cylinder 1.

During manufacturing, shipping and/or assembling of cylinder 1, plate tumblers 11 must be retained within the individual slots or wards 12 so that they cannot "pop out" or fall out of housing 2 when key 5 is removed. In order to accomplish this, a retaining means is provided which enables each plate tumbler 11 to be "self-retaining" in that no extra parts are necessary for retaining tumblers 11 within housing 2 in addition to those already described herein. In order to accomplish this, each plate tumbler 11 includes detent 29 formed along side edge 18 which functions to catch or engage retaining ledge 24 formed on side wall 20 of ward 12. As another feature of the present invention, the retaining of tumblers 11 in wards 12 is accomplished without any physical damage, i.e. metal deformation to the structure of tumbler 11, detent 29 or retaining ledge 24. This latter feature is accomplished by locating projecting leg 30 of tumbler 11 sufficiently toward the top of tumbler 11 so that upper seat 31 is spaced from terminal edge 23 of ward 12 when tumbler 11 is in its assembled position. In other words, as shown best in FIG. 3, the distance between lower seat 25 and upper seat 31 is greater than the distance between terminal edge 23 and lower seat 25. This provides sufficient clearance between seat 31 of leg 30 and terminal edge 23 to enable tumbler 11 to be pivoted during insertion into ward 12 to thereby reduce to a minimum the forces interacting between detent 29 and retaining ledge 24. As a result, no metal deformation occurs with either detent 29 or retaining ledge 24 during the insertion and resultant snapping in of tumbler 11 into ward 12.

In operation, tumbler 11 is retained within cylinder 1 in the following manner. First, tumbler spring 17 is inserted into ward 12 within housing 2 through the open top 14 of ward 12 until spring 17 is engaged with lower seat 25. Plate tumbler 11 is then inserted into ward 12 through the open top 14 of ward 12 and pushed into cylinder 1 to compress spring 17. When detent 29 is received within ward 12 and begins to slidably engage side wall 20, tumbler 11 is pivoted away from side wall 20, i.e. to the right in FIG. 2, to minimize the sliding forces between detent 29 and side wall 20. Thereafter, tumbler 11 is pushed into ward 12 until detent 29 passes by retaining ledge 24 so that its upper surface clears the edge of retaining ledge 24. When this occurs, the force of tumbler spring 17, which is now substantially compressed, acts against the undersurface or seat 31 of leg 30 to pivot tumbler 11 in a direction toward side wall 20. At the same time, lower comer 33 of tumbler 11 engages side wall 21 to trap or hold tumbler 11 in its upright position (see FIG. 3). Tumbler 11 thus moves from its initial non-assembled position to an assembled position wherein it snaps into ward 12. As shown best in FIG. 2, the clearance between seat 31 and terminal edge 23 enables the initial pivoting and the reverse, snap-in pivoting to occur without interference or hinderance between tumbler 11 and wards 12 and without any metal deformation of detent 29 and retaining ledge 24. As shown best in FIG. 3, tumbler 11 has been moved from its non-assembled position, which is shown in FIG. 2, to its assembled position. In its assembled position, tumbler 11 is "self-retained" since the interference of detent 29 with retaining ledge 24 and of comer 33 with side wall 21 prevents tumbler 11 from being forced out of ward 12 by spring 17. This procedure is repeated until all of the tumblers are inserted into their respective wards 12.

In order to remove tumbler 11 from cylinder 1, the opposite procedure from that described above is performed. In other words, from the assembled position shown in FIG. 3, tumbler 11 is pivoted away from side wall 20, i.e. to the right in FIG. 3, until detent 29 clears retaining ledge 24, as shown in phantom lines in FIG. 3. Tumbler 11 then "pops out" due to the force of spring 17. This procedure is repeated until all of the tumblers are removed from their respective wards 12.

It should also be noted that the tolerances of some lock configurations may also require that additional relief be provided so that adequate room for pivoting the tumbler 11 is available. In order to accomplish this, a chamfered or inclined surface 26 is formed on the inner edge of seat 25. Preferably, surface 26 is formed at a 45° angle, and as shown best in FIG. 2, results in the ability of tumbler 11 to be sufficiently pivoted until detent 29 clears retaining ledge 24. Relief surface 26 thus insures that no metal deformation will occur between the components of tumbler 11 and housing 2.

In some assemblies, it may also be necessary to provide additional "relief" of the forces acting between detent 29 and retaining ledge 24. This is accomplished by providing a further recess 27 in side wall 21. This is best illustrated in FIG. 3 where an inclined surface or comer 28 is formed to thereby space wall 21 away from spring 17 and form recess 27. Recess 27 along side wall 21 extends between lower seat 25 and terminal edge 23.

Referring now to FIG. 4, there is illustrated the operational position for tumbler 11. As shown, cylinder 1 is mounted within sleeve 8 with tumbler 11 projecting from the outer cylindrical surface 15 of cylinder 1 into a slot 9 formed in sleeve 8. Tumbler 11 is thus in its operational position resulting in the locking of cylinder 1 with respect to sleeve 8. As illustrated, detent 29 is now spaced from retaining ledge 24 and outer tip 32 of leg 30 is located within ward 12 adjacent side wall 21. Thus, in this operational position, tumbler 11 can no longer be pivoted. However, should cylinder 1 be removed from sleeve 8, spring 17 will urge tumbler 11 outwardly until detent 29 engages or catches retaining ledge 24 to prevent tumbler 11 from popping out of ward 12. Thereafter, the above described procedure for removing and/or replacing tumblers 11 may be accomplished.

A self-retained, snap-fitting tumbler for a plate tumbler lock has been illustrated and described. Various modifications and/or substitutions of the specific components described herein may be made without departing from the scope of the present invention. For example, the specific shape of detent 29 may be modified to cooperate with specific designs for the retaining ledge 24. Also, different shapes of plate tumblers 11 may be employed other than that specifically described herein. In addition, the cylinder construction described and illustrated herein may be utilized with "double throw" locks, i.e. tumblers that are biased and project radially in opposite directions from a cylinder. These and other modifications can be made herein without departing from the scope of the present invention.

Various modes of carrying out the invention are contemplated as being within the scope of the following claims particularly pointing out and distinctly claiming the subject matter regarded as the invention.

I claim:

1. A cylinder assembly for a plate tumbler lock, comprising:

a cylindrical housing defining an external cylindrical surface, opposite ends, a longitudinal axis and a key way disposed along said axis opening to one end of said housing for slidably receiving a key therein, said housing further including a tumbler ward extending radially from said axis and having an open top which opens to said external cylindrical surface, said tumbler ward defined by a pair of opposite side walls, one of said side walls including a tumbler retaining ledge formed therein and the other of said side walls including a first tumbler spring seat formed therein, and each of said side walls including a terminal edge at said external cylindrical surface defining said open top;

a plate tumbler disposed in said ward for sliding movement radially with respect to said axis, said plate tumbler including opposite side edges, one of said side edges including a detent projecting therefrom and the other of said side edges including a leg projecting therefrom defining a second tumbler spring seat;

tumbler spring means within said housing located between said first seat and a terminal edge for biasing said plate tumbler outwardly in said ward toward said open top, said tumbler spring means having a lower end engaging the first seat formed in said other side wall and an upper end engaging said second seat formed in said leg; and said plate tumbler slidably moveable in said ward between a non-assembled position and an assembled position wherein said detent engages said retaining ledge and said second tumbler spring seat is spaced from the terminal edge of said other side wall such that the distance between said first and second tumbler spring seats is greater than the distance between said first tumbler seat and the terminal edge of said other wall so that said tumbler snap-fits into and is retained within said tumbler ward without any physical damage to said retaining ledge and said detent by allowing said plate tumbler to move within said tumbler ward upon insertion of said plate tumbler into said tumbler ward.

2. The cylinder assembly of claim 1 further including relief means for providing clearance between said first seat and the other side edge of said plate tumbler.

3. The cylinder assembly of claim 2 wherein said relief means comprises an inclined surface formed in said first seat.

4. The cylinder assembly of claim 3 wherein said inclined surface is inclined at an angle of about 45°.

5. The cylinder assembly of claim 2 wherein said relief means comprises a recess formed in said other side wall adjacent said first tumbler spring seat.

6. The cylinder assembly of claim 5 wherein said recess extends between said first tumbler spring seat and said terminal edge of said other side wall.

7. The cylinder assembly of claim 1 wherein the movement of said tumbler within said tumbler ward upon insertion is a pivotal movement with respect to said longitudinal axis.

8. The cylinder assembly of claim 1 wherein said tumbler is removable from said tumbler ward without causing any physical damage to said retaining ledge and said detent.

9. The cylinder assembly of claim 1 wherein said tumbler includes a lower comer formed along said other of said side edges, said comer engageable with said other of said side walls of said tumbler ward to hold said tumbler in said assembled position.

* * * * *

UNITED STATES PATENT AND TRADEMARK OFFICE

CERTIFICATE OF CORRECTION

PATENT NO. : 5,438,856

DATED : August 8, 1995

INVENTOR(S) : Carl E. Richter et al

It is certified that error appears in the above-indentified patent and that said Letters Patent is hereby corrected as shown below:

| | |
|---|---|
| On the title page item [56], under U.S. Documents, tenth reference | Delete "5,068,305" and substitute therefor ---5,088,305---. |

Signed and Sealed this

Fifth Day of November, 1996

*Attest:*

Bruce Lehman

BRUCE LEHMAN

*Attesting Officer*

*Commissioner of Patents and Trademarks*